US012044078B2

(12) United States Patent
Banditrat et al.

(10) Patent No.: US 12,044,078 B2
(45) Date of Patent: Jul. 23, 2024

(54) DOWNHOLE TOOL CONNECTION FORMED FROM MULTIPLE MATERIALS

(71) Applicants: Thomas Banditrat, Houston, TX (US); Grant Loper, Lake City, CO (US); Mike Matheson, Cypress, TX (US); Claudia Leon, Houston, TX (US)

(72) Inventors: Thomas Banditrat, Houston, TX (US); Grant Loper, Lake City, CO (US); Mike Matheson, Cypress, TX (US); Claudia Leon, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/889,481

(22) Filed: Aug. 17, 2022

(65) Prior Publication Data

US 2024/0060368 A1 Feb. 22, 2024

(51) Int. Cl.
*E21B 17/042* (2006.01)

(52) U.S. Cl.
CPC ..... *E21B 17/0423* (2013.01)

(58) Field of Classification Search
CPC ..... F16L 15/001; F16L 15/006; F16L 15/002; F16L 15/007; E21B 17/042; E21B 17/0423
See application file for complete search history.

(56) References Cited

U.S. PATENT DOCUMENTS

| | | | | |
|---|---|---|---|---|
| 4,506,432 | A * | 3/1985 | Smith | E21B 17/042 |
| 5,360,239 | A * | 11/1994 | Klementich | F16L 15/001 |
| 6,863,313 | B1 * | 3/2005 | DeLange | E21B 17/042 |
| 2004/0090068 | A1 * | 5/2004 | Evans | E21B 17/042 |
| 2007/0228729 | A1 * | 10/2007 | Grimmett | F16L 15/004 |
| 2015/0368986 | A1 * | 12/2015 | Narikawa | E21B 17/042 |
| 2018/0216416 | A1 | 8/2018 | Ethridge et al. | |

FOREIGN PATENT DOCUMENTS

| | | |
|---|---|---|
| CN | 113107384 A | 7/2021 |
| EP | 2780618 B1 | 9/2019 |
| EP | 3320172 B1 | 1/2020 |

OTHER PUBLICATIONS

International Search Report and Written Opinion mailed Nov. 29, 2023 in PCT/US2023/030038; 10 pages (BAO2191PCT).

* cited by examiner

*Primary Examiner* — Zachary T Dragicevich
(74) *Attorney, Agent, or Firm* — CANTOR COLBURN LLP

(57) ABSTRACT

A downhole component includes a member formed from a first material. The member includes an end having a first plurality of external threads and a second end having a first plurality of internal threads. One of the first plurality of external threads and the second plurality of internal threads includes a first portion formed from the first material and a second portion formed from a second material that is distinct from the first material.

20 Claims, 4 Drawing Sheets

DOWNHOLE TOOL CONNECTION FORMED FROM MULTIPLE MATERIALS

BACKGROUND

In the resource recovery industry and fluid sequestration industry a system of tubulars are introduced into a formation to deliver, circulate, and/or retrieve fluids, transport tools, perform drilling operations and the like. The system of tubulars is made up of individual tubulars, joined one to another, to form a tubular string. Tubulars are joined by threading a pin end of one tubular into a box end of another tubular to make up a tubular joint.

Often times, an elastomeric seal or a metal seal is arranged over the pin end of a tubular to reduce leakage from the tubular joint. Making up a tubular string is a time consuming and labor intensive operation. Adding elastomeric seals to each joint adds to the time, cost, and materials needed to form a tubular string. Further, over time, elastomeric seals may fail leading to a leak after the tubular string is set in a formation. Accordingly, the industry would welcome a system for reducing leakage at tubular joints that does not add time to joining tubulars or which will, over time, may fail.

SUMMARY

A downhole component, in accordance with a non-limiting example, includes a member formed from a first material. The member includes an end having a first plurality of external threads and a second end having a first plurality of internal threads. One of the first plurality of external threads and the second plurality of internal threads includes a first portion formed from the first material and a second portion formed from a second material that is distinct from the first material.

A resource exploration and recovery system, in accordance with a non-limiting example, includes a surface system and a subsurface system including a downhole component. The downhole component includes a first member formed from a first base material. The first member includes a first end having a first plurality of external threads and a second end having a first plurality of internal threads. A second member is formed from a second base material. The second member includes a first end portion having a second plurality of external threads and a second end portion having a second plurality of external threads. The first plurality of external threads engage with the second plurality of internal threads to form a tubular joint. One of the first plurality of external threads and the second plurality of internal threads includes a first portion formed from a corresponding one of the first base material and the second base material and a second portion formed from a second material that is distinct from the first base material and the second base material, respectively.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
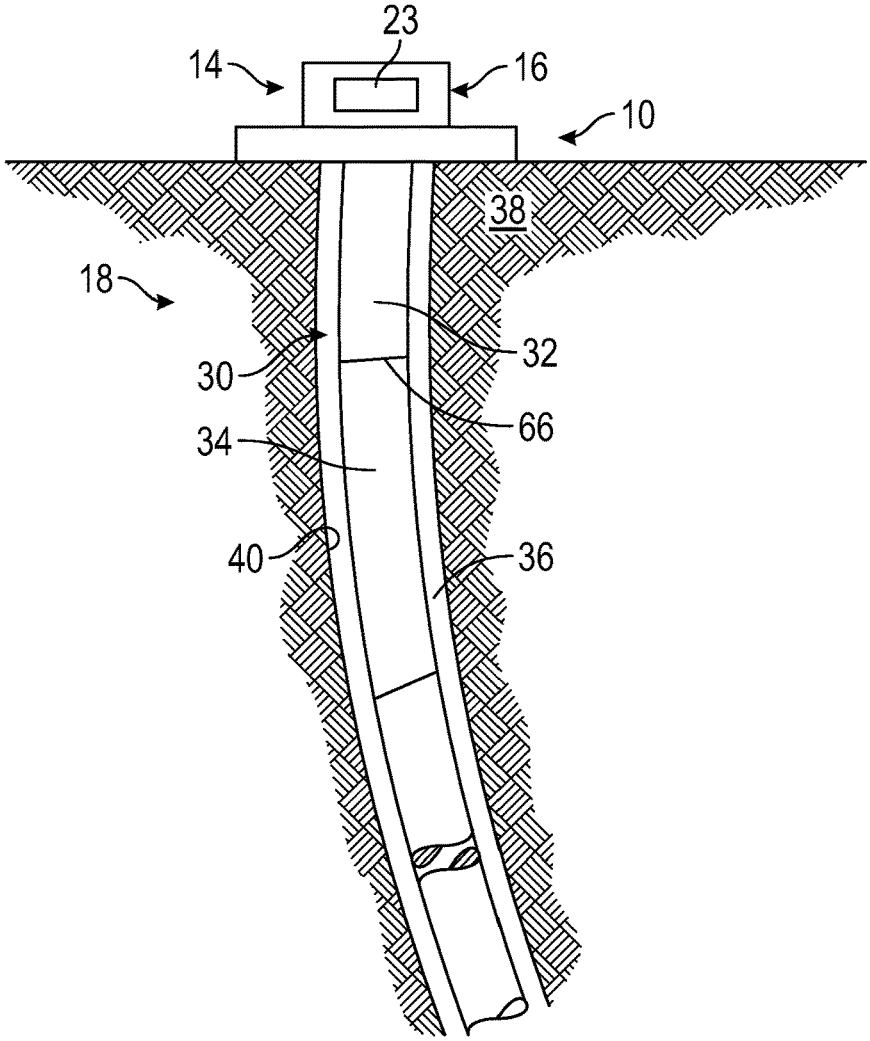
FIG. 1 depicts a resource exploration and recovery system including a system of tubulars joined by a connection formed from multiple materials, in accordance with a non-limiting example.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subterranean system.

First system 14 may include a control system 23 that may provide power to, monitor, communicate with, and/or activate one or more downhole operations as will be discussed herein. Surface system 16 may include additional systems such as pumps, fluid storage systems, cranes, and the like (not shown). Second system 18 may include a system of tubulars 30, formed from one or more tubular members, such as first tubular 32 connected to a second tubular 34. System of tubulars 30 extends into a wellbore 36 formed in a formation 38. Wellbore 36 includes an annular wall 40 which may be defined by a surface (not separately labeled) of formation 38.

Figure 2:
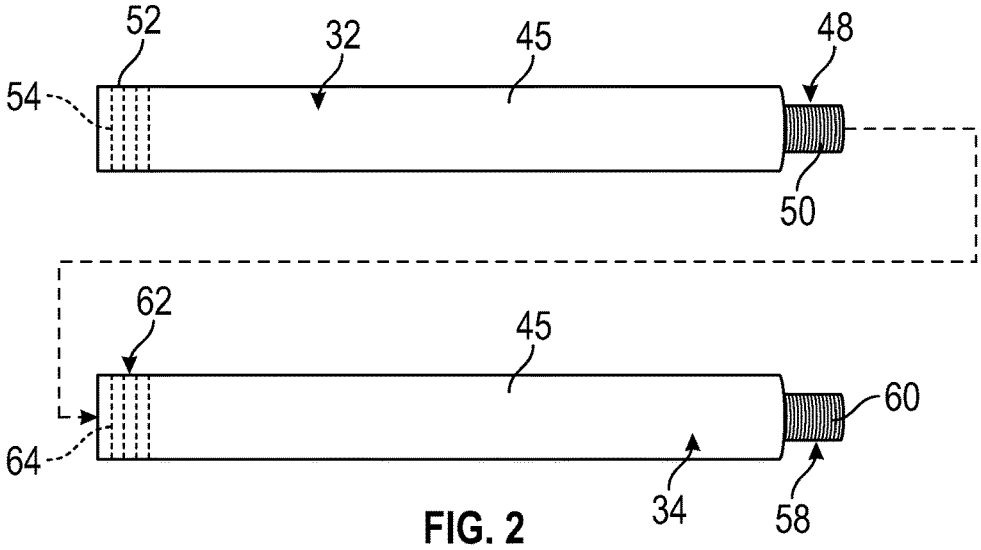
FIG. 2 depicts a first tubular and a second tubular that may be joined to form the system of tubulars of FIG. 1.

Referring to FIG. 2, first tubular 32 is formed from a first base material 45 such as tempered steel and includes a first pin end 48 having a first plurality of external threads 50 and a first box end 52 having a first plurality of internal threads 54. Second tubular 34 is formed from a second base material. In a non-limiting example, the second base material may be the same as first base material 45 and includes a second pin end 58 having a second plurality of external threads 60 and a second box end 62 having a second plurality of internal threads 64. First pin end 48 may be received by second box end 62 with first plurality of external threads 50 engaging with second plurality of internal threads 64 to form a joint 66 (FIG. 1).

Figure 3:
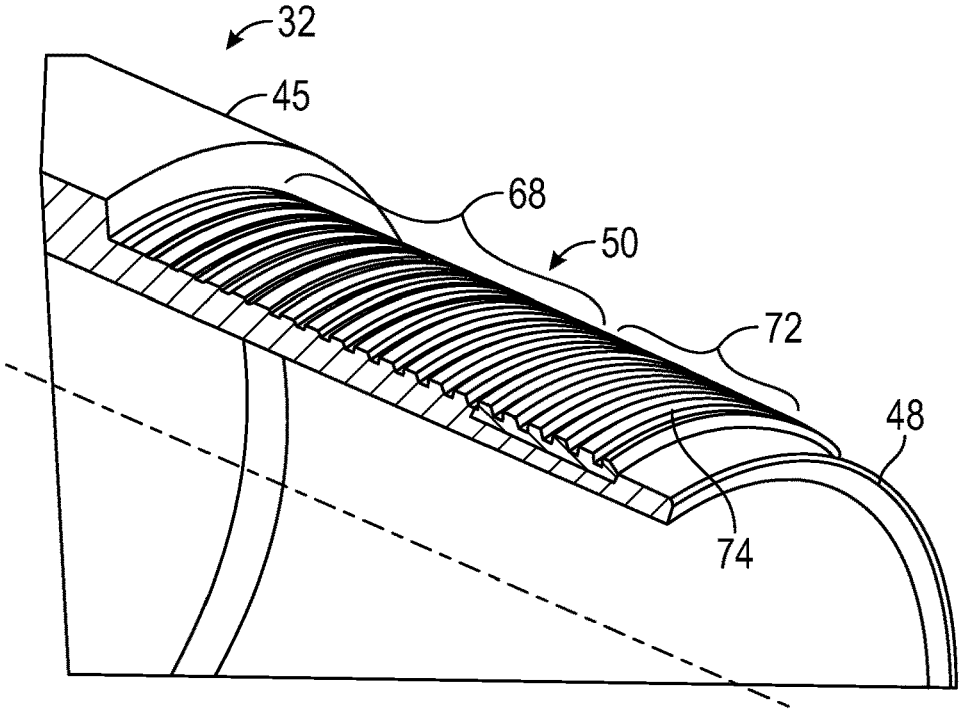
FIG. 3 depicts a first pin end of the first tubular including a first plurality of external threads formed from two materials, in accordance with a non-limiting example.

In a non-limiting example depicted in FIG. 3, first plurality of external threads 50 include a first portion 68 formed from the first base material 45 and a second portion 72 formed from a second material 74. In a non-limiting example, second material 74 may have a hardness that is greater than a hardness of the first material. In another non-limiting example, second material 74 may have a hardness that is less than the hardness of the first material. The particular material properties of second material 74 may vary depending upon a particular application. For example, if sealing is a desired attribute, second material 74 may have a hardness that is less than the hardness of the first material. If increased tensile strength is a desired attribute, second material 74 may have a hardness that is greater than the hardness of the first material. The particular choice for second material 74 may vary depending on desired attributes.

Figure 4:
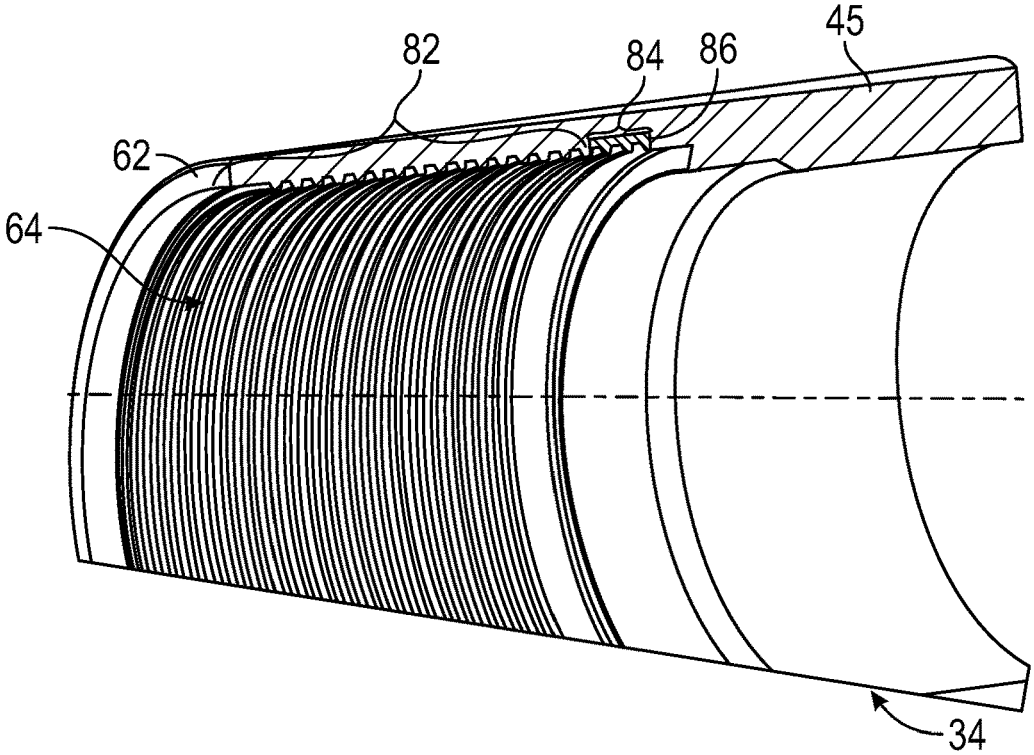
FIG. 4 depicts a second box end of the second tubular including a second plurality of internal threads formed from two materials, in accordance with a non-limiting example.

In a non-limiting example depicted in FIG. 4, first plurality of internal threads 64 include a first portion 82 formed from the first base material 45 and a second portion 84 formed from a second material 86. In a non-limiting example, second material 86 may have a hardness that is greater than a hardness of the first material. In another non-limiting example, second material 86 may have a hardness that is less than the hardness of the first material. The particular material properties of second material 86 may vary depending upon a particular application. For example, if sealing is a desired attribute, second material 86 may have a hardness that is less than the hardness of the first material. If increased tensile strength is a desired attribute, second material 86 may have a hardness that is greater than the hardness of the first material. The particular choice for second material 86 may vary depending on desired attributes.

Figure 5:
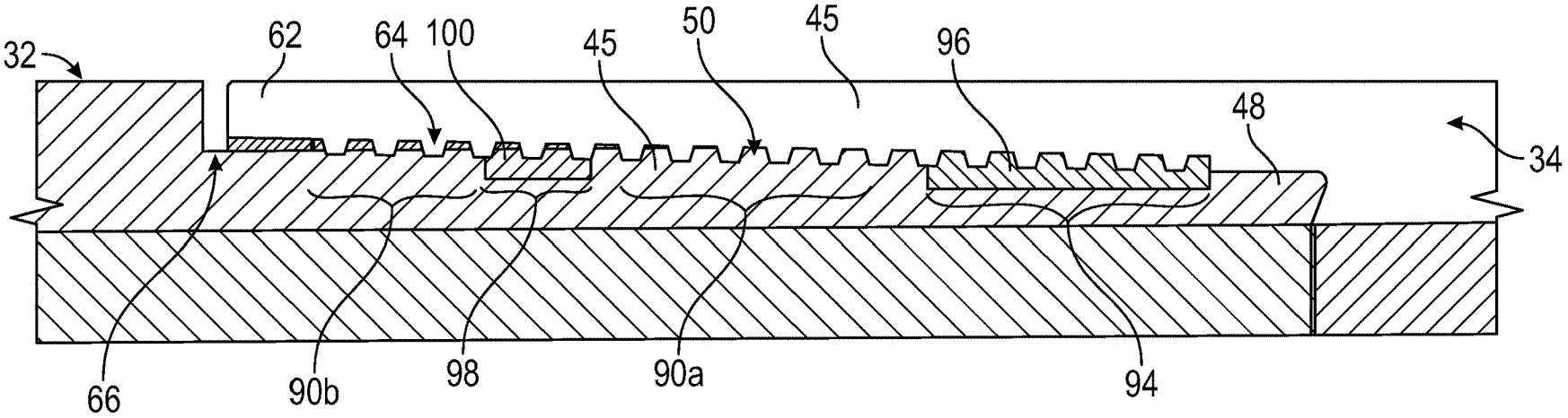
FIG. 5 depicts the first tubular joined with the second tubular with the first plurality of external threads being formed from three materials, in accordance with a non-limiting example.

In a non-limiting example shown in FIG. 5, first plurality of external threads 50 mate with second plurality of internal threads 64 on second tubular 34. First plurality of external threads includes a first portion 90*a* and 90*b* formed from first base material 45, a second portion 94 formed from a second material 96, and a third portion 98 formed from a third material 100. Second material 96 may have a hardness that is less than the hardness of first base material 45 and third material 100 may have a hardness that is greater than the hardness of first base material 45. In this manner, first plurality of external threads 50 have a composite or hybrid structure with second material 96 providing additional sealing properties and third material 100 providing additional strength properties.

Figure 6:
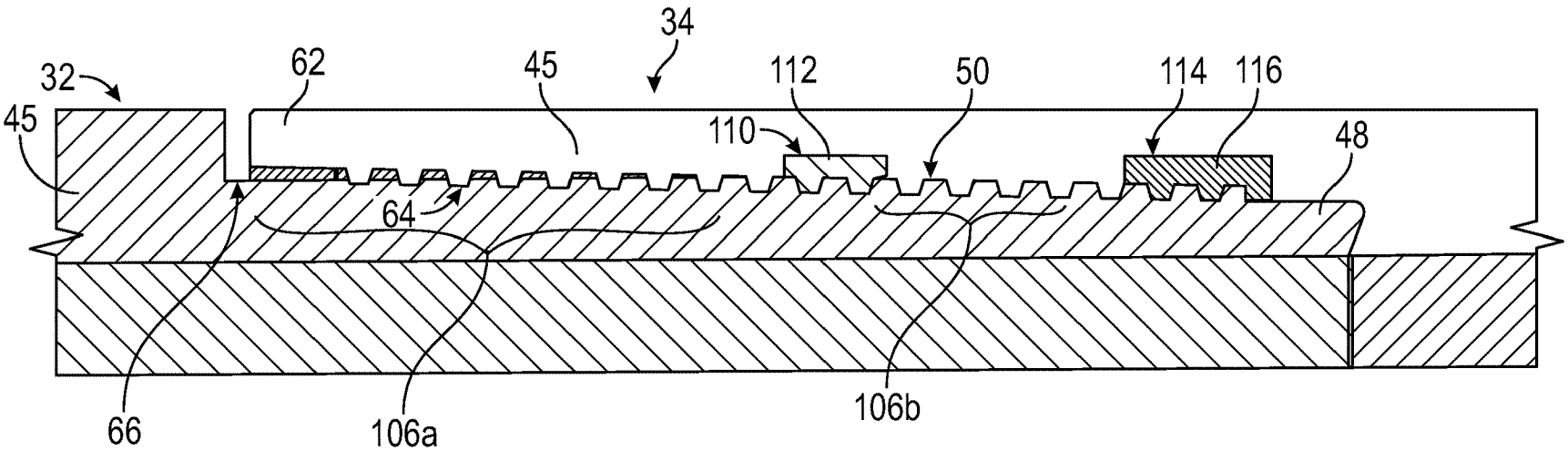
FIG. 6 depicts the first tubular joined with the second tubular with the second plurality of internal threads being formed from three materials, in accordance with a non-limiting example.

In a non-limiting example shown in FIG. 6, first plurality of external threads 50 mate with second plurality of internal threads 64 on second tubular 34. In a non-limiting example, second plurality of internal threads 64 includes a first portion 106*a* and 106*b* formed from first base material 45, a second portion 110 formed from a second material 112, and a third portion 114 formed from a third material 116. Second material 112 may have a hardness that is less than the hardness of first base material 45 and third material 116 may have a hardness that is greater than the hardness of first base material 45. In this manner, second plurality of internal threads 64 have a composite or hybrid structure with second material 112 providing additional sealing properties and third material 116 providing additional strength properties.

Figure 7:
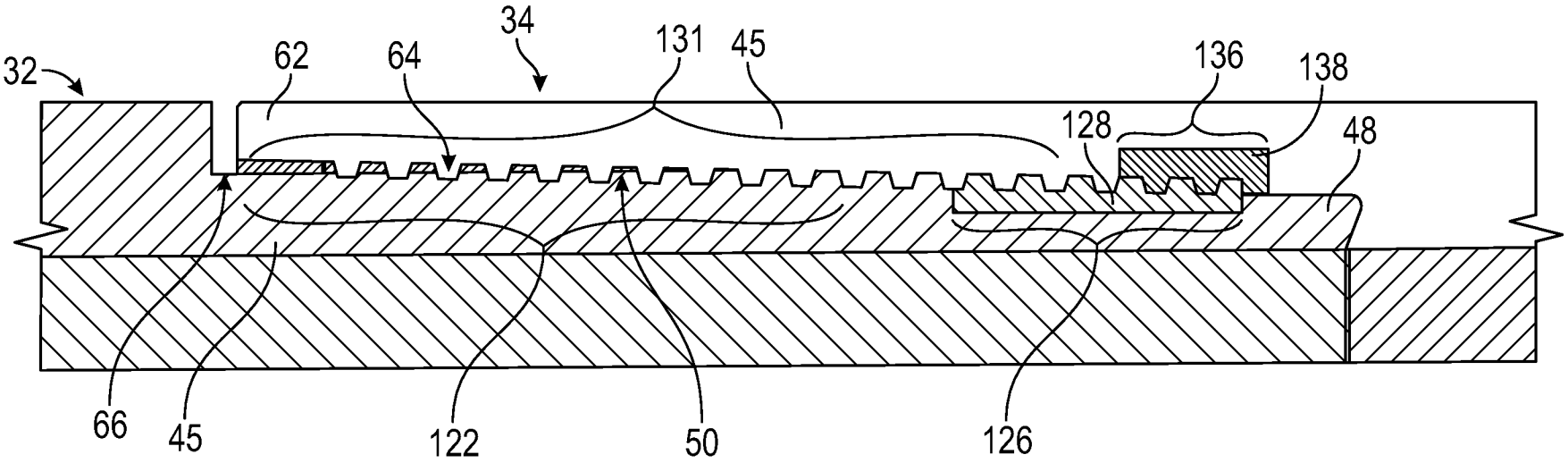
FIG. 7 depicts the first tubular joined with the second tubular with the first plurality of external threads being formed from two materials and the second plurality of internal threads being formed from two materials, in accordance with a non-limiting example.

In a non-limiting example shown in FIG. 7, first plurality of external threads 50 includes a first portion 122 formed from first base material 45, a second portion 126 formed from a second material 128. Second plurality of internal threads 64 includes a first portion 131 formed from first base material 45, a second portion 136 formed from a third material 138. In the non-limiting example shown, second portion 126 of first plurality of external threads 50 engage with second portion 136 of second plurality of internal threads 64 with second material 128 interlocking with third material 138.

In a non-limiting example, second material 128 may have a hardness that is greater than the hardness of first base material 45 and third material 138 may have a hardness that is less than the hardness of first base material 45. In this manner, first plurality of external threads 50 and second plurality of internal threads 64 form a hybrid joint having both increased sealing properties and increased strength properties.

At this point, while second tubular 34 is described as being formed from the same material as first tubular 32, the material used to form each tubular 32, 34 may vary. Further, while the second plurality of internal threads 64 are described as including one or more materials that are different from the material that forms the tubular, the one or more materials may also exist on the first plurality of internal threads 54. It should also be understood, that while threads are described as connecting tubulars, composite, or hybrid threads such as described herein may be used to connect tools and other mechanical components employed in a downhole environment. Further, while shown as being used in connection with tapered surfaces composite, or hybrid threads such as described herein may be formed on non-tapered surfaces as well.

Set forth below are some embodiments of the foregoing disclosure:

Embodiment 1. A downhole component comprising: a member formed from a first material, the member including an end having a first plurality of external threads and a second end having a first plurality of internal threads, wherein one of the first plurality of external threads and the second plurality of internal threads includes a first portion formed from the first material and a second portion formed from a second material that is distinct from the first material.

Embodiment 2. The downhole component according to any prior embodiment, wherein the first material has a first hardness and the second material has a second hardness that is distinct from the first hardness.

Embodiment 3. The downhole component according to any prior embodiment, wherein the second hardness is less than the first hardness.

Embodiment 4. The downhole component according to any prior embodiment, wherein the one of the first plurality of external threads and the first plurality of internal threads includes a third portion formed from a third material having a third hardness that is distinct from the first material.

Embodiment 5. The downhole component according to any prior embodiment, wherein the second hardness is less than the first hardness and the third hardness is greater than the first hardness.

Embodiment 6. The downhole component according to any prior embodiment, wherein the second material forms the second portion of the first plurality of external threads, the third material forms the third portion of the first plurality of external threads.

Embodiment 7. The downhole component according to any prior embodiment, wherein the second material forms the second portion of the first plurality of internal threads and the third material forms the third portion of the first plurality of internal threads.

Embodiment 8. The downhole component according to any prior embodiment, wherein the second material forms the second portion of the first plurality of external threads and the third material forms the third portion of the first plurality of internal threads.

Embodiment 9. The downhole component according to any prior embodiment, wherein the second material forms the second portion of the first plurality of external threads.

Embodiment 10. The downhole component according to any prior embodiment, wherein the member defines a tubular with the end having the first plurality of external threads defining a pin end of the tubular and the end having the first plurality of internal threads defines a box end of the tubular.

Embodiment 11. A resource exploration and recovery system comprising: a surface system; and a subsurface system including a downhole component, the downhole component comprising: a first member formed from a first base material, the first member including a first end having a first plurality of external threads and a second end having a first plurality of internal threads; a second member formed from a second base material, the second member including a first end portion having a second plurality of external threads and a second end portion having a second plurality of external threads, the first plurality of external threads engaging with the second plurality of internal threads to form a tubular joint, wherein one of the first plurality of external threads and the second plurality of internal threads includes a first portion formed from a corresponding one of the first base material and the second base material and a second portion formed from a second material that is distinct from the first base material and the second base material, respectively.

Embodiment 12. The resource exploration and recovery system according to any prior embodiment, wherein the first base material has a first hardness and the second material has a second hardness that is distinct from the first hardness.

Embodiment 13. The resource exploration and recovery system according to any prior embodiment, wherein the second hardness is less than the first hardness.

Embodiment 14. The resource exploration and recovery system according to any prior embodiment, wherein the one of the first plurality of external threads and the second plurality of internal threads includes a third portion formed from a third material having a third hardness that is distinct from the corresponding one of the first base material and the second base material.

Embodiment 15. The resource exploration and recovery system according to any prior embodiment, wherein the second hardness is less than the first hardness and the third hardness is greater than the first hardness.

Embodiment 16. The resource exploration and recovery system according to any prior embodiment, wherein the second material and the third material form the second portion and the third portion of the first plurality of external threads.

Embodiment 17. The resource exploration and recovery system according to any prior embodiment, wherein the second material and the third material form the second portion and the third portion of the second plurality of internal threads.

Embodiment 18. The resource exploration and recovery system according to any prior embodiment, wherein the second material forms the second portion of the first plurality of external threads and the third material forms the third portion of the second plurality of internal threads.

Embodiment 19. The resource exploration and recovery system according to any prior embodiment, wherein the second material forms the second portion of the first plurality of external threads.

Embodiment 20. The resource exploration and recovery system according to any prior embodiment, wherein the first member comprises a first tubular with the first end defining a pin end of the first tubular and the second end defining a box end of the first tubular; and wherein the second member comprises a second tubular with the first end portion defining a pin end of the second tubular and the second end portion defining a box end of the second tubular.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole component comprising:

a member formed from a first material, the member including an end having a first nose and a first plurality of external threads extending along the member from the first nose and a second end having a second nose and a first plurality of internal threads extending along the member from the second nose, at least one of the first plurality of external threads and the first plurality of internal threads includes a recess spaced from the one of the first nose and the second nose, wherein the one of the first plurality of external threads and the first plurality of internal threads includes a first portion integrally formed with the member from the first material and a second portion of the one of the first plurality of external threads and the first plurality of internal threads formed from a second material that is distinct from the first material the second portion being formed separately from and secured to the member in the recess.

2. The downhole component according to claim 1, wherein the first material has a first hardness and the second material has a second hardness that is distinct from the first hardness.

3. The downhole component according to claim 1, wherein the second hardness is less than the first hardness.

4. The downhole component according to claim 3, wherein the one of the first plurality of external threads and the first plurality of internal threads includes a third portion formed from a third material having a third hardness that is distinct from the first material the third portion being formed separately from and secured to the member in another recess.

5. The downhole component according to claim 4, wherein the second hardness is less than the first hardness and the third hardness is greater than the first hardness.

6. The downhole component according to claim 4, wherein the second material forms the second portion of the first plurality of external threads, the third material forms the third portion of the first plurality of external threads.

7. The downhole component according to claim 4, wherein the second material forms the second portion of the first plurality of internal threads and the third material forms the third portion of the first plurality of internal threads.

8. The downhole component according to claim 4, wherein the second material forms the second portion of the first plurality of external threads and the third material forms the third portion of the first plurality of internal threads.

9. The downhole component according to claim 1, wherein the second material forms the second portion of the first plurality of external threads.

10. The downhole component according to claim 1, wherein the member defines a tubular with the end having the first plurality of external threads defining a pin end of the tubular and the end having the first plurality of internal threads defines a box end of the tubular.

11. A resource exploration and recovery system comprising:

a surface system; and a subsurface system including a downhole component, the downhole component comprising:

a first member formed from a first base material having a first hardness, the first member including a first end having a first nose and a first plurality of external threads extending from the first nose along the first member and a second end having a second nose and a first plurality of internal threads extending from the first nose along the first member;

a second member formed from a second base material having the first hardness, the second member including a first end portion having a first nose portion and a second plurality of external threads extending from the first nose portion along the second member and a second end portion having a second nose portion and a second plurality of internal threads extending from the second nose portion along the second member, the first plurality of external threads engaging with the second plurality of internal threads to form a tubular joint, at least one of the first plurality of external threads and the first plurality of internal threads including a first recess spaced from the corresponding one of the first nose and the second nose and at least one of the second plurality of external thread and the second plurality of internal threads includes a second recess spaced from the corresponding one of the first nose portion and the second nose portion, wherein one of the first plurality of external threads and the second plurality of internal threads includes a first portion integrally formed with the member from a corresponding one of the first base material and the second base material and a second portion formed from a second material that is distinct from the first base material and the second base material, respectively the second portion being formed separately from and secured to the corresponding one of the first member and the second member in the corresponding one of the first recess and the second recess.

12. The resource exploration and recovery system according to claim 11, wherein the first base material has a first hardness and the second material has a second hardness that is distinct from the first hardness.

13. The resource exploration and recovery system according to claim 12, wherein the second hardness is less than the first hardness.

14. The resource exploration and recovery system according to claim 12, wherein the one of the first plurality of external threads and the second plurality of internal threads includes a third portion formed from a third material having a third hardness that is distinct from the corresponding one of the first base material and the second base material the third portion being formed separately from and secured to the corresponding one of the first member and the second member in another recess.

15. The resource exploration and recovery system according to claim 14, wherein the second hardness is less than the first hardness and the third hardness is greater than the first hardness.

16. The resource exploration and recovery system according to claim 14, wherein the second material and the third material form the second portion and the third portion of the first plurality of external threads.

17. The resource exploration and recovery system according to claim 14, wherein the second material and the third material form the second portion and the third portion of the second plurality of internal threads.

18. The resource exploration and recovery system according to claim 14, wherein the second material forms the second portion of the first plurality of external threads and the third material forms the third portion of the second plurality of internal threads.

19. The resource exploration and recovery system according to claim 11, wherein the second material forms the second portion of the first plurality of external threads.

20. The resource exploration and recovery system according to claim 11, wherein the first member comprises a first tubular with the first end defining a pin end of the first tubular and the second end defining a box end of the first tubular; and wherein the second member comprises a second tubular with the first end portion defining a pin end of the second tubular and the second end portion defining a box end of the second tubular.

* * * * *